US008413647B2

(12) United States Patent
Nam et al.

(10) Patent No.: US 8,413,647 B2
(45) Date of Patent: Apr. 9, 2013

(54) COOKER

(75) Inventors: Hyeun Sik Nam, Seoul (KR); Dong Seong Kwag, Seoul (KR); Wan Soo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 750 days.

(21) Appl. No.: 12/554,169

(22) Filed: Sep. 4, 2009

(65) Prior Publication Data

US 2010/0059035 A1 Mar. 11, 2010

(30) Foreign Application Priority Data

Sep. 5, 2008 (KR) ..... 10-2008-0087606

(51) Int. Cl.
*F24C 15/32* (2006.01)

(52) U.S. Cl.
USPC ..... 126/21 A; 126/19 R; 126/20; 126/22; 126/299 R; 219/400; 219/407; 219/534

(58) Field of Classification Search ..... 126/21 A, 126/19 R, 20, 22, 299 R; 219/400, 407, 534
See application file for complete search history.

(56) References Cited

U.S. PATENT DOCUMENTS

| | | | | |
|---|---|---|---|---|
| 6,008,478 | A * | 12/1999 | Crone et al. | 219/402 |
| 6,521,870 | B2 | 2/2003 | Nolan et al. | 219/400 |
| 6,831,255 | B1 * | 12/2004 | Levi et al. | 219/400 |
| 2007/0125766 | A1 * | 6/2007 | Ryu et al. | 219/601 |
| 2008/0006620 | A1 * | 1/2008 | Lee et al. | 219/534 |
| 2008/0121635 | A1 | 5/2008 | Lee | |

FOREIGN PATENT DOCUMENTS

| | | | |
|---|---|---|---|
| CN | 1779349 | A | 5/2006 |
| CN | 201014589 | | 1/2008 |
| EP | 1 058 483 | A1 | 12/2000 |
| JP | 11-287460 | | 10/1999 |

OTHER PUBLICATIONS

Chinese Office Action dated Aug. 11, 2011.
Chinese Office Action dated Nov. 2, 2010 (Application No. 200910168189.4) (Translation).

* cited by examiner

*Primary Examiner* — Avinash Savani
(74) *Attorney, Agent, or Firm* — KED & Associates LLP

(57) ABSTRACT

Provided is a cooker. A carbon heater used as a convection heater is supported by a heater bracket and heater supporters, and light and heat generated from the carbon heater are transferred to the inside of a cooking chamber through convection, conduction, and radiation.

19 Claims, 14 Drawing Sheets

COOKER

CROSS REFERENCES RELATED APPLICATIONS

The present application claims priority under 35 U.S.C. 119 and 35 U.S.C. 365 to Korean Patent Application No. 10-2008-0087606(filed on Sep. 5, 2008), which is hereby incorporated by reference in its entirety.

BACKGROUND

The present invention relates to a cooker, and in particular, to a cooker that heats food using a carbon heater.

A cooker is a home appliance that heats food using electricity. Such a cooker is provided with a cooking chamber where food is cooked and at least one heater for cooking food in the cooking chamber. For example, the cooker may be provided with a heater that performs radiant heat on food inside the cooking chamber, a convection heater that performs convection heat on food inside the cooking chamber, etc.

However, the cooker according to the related art has the following problems.

First, a sheath heater is mainly used as the heater or the convection heater in the related art. However, in the case of the sheath heater, it is operated at a relatively low output compared to a heater having other sort of output, for example, a carbon heater. Therefore, disadvantages arise in that cooking time is increased simultaneously with lowering cooking efficiency of food by the carbon heater inside the cooking chamber.

In addition, in the case of the convection heater, it is commonly installed on a rear surface or a side surface of the cooking chamber. Therefore, when the carbon heater is used as the convection heater, the carbon heater should be fixed so that a tube forming the external appearance thereof is prevented from being damaged. However, such a fixing structure of the carbon heater has not been proposed up to now.

SUMMARY

Embodiments provide a cooker, which is configured to be able to efficiently cook food.

Embodiments provide a cooker, which is configured to be able to minimize damage of a carbon heater that is used as a convection heater.

In one embodiment, a cooker, comprising: a cavity that is provided with a cooking chamber; a convection chamber that is communicated with the cooking chamber; a plate that partitions the cooking chamber and the convection chamber; a carbon heater that is installed inside the convection chamber and includes a quartz tube and a carbon filament provided inside the quartz tube; a fixing member that fixes the carbon heater to the inside of the convection chamber; and a convection fan that is installed inside the convection chamber and forms a flow of air that convects heat of the carbon heater to the inside of the cooking chamber.

In another embodiment, a cooker, comprising: a cavity that is provided with a cooking chamber; a convection chamber that is communicated with the cooking chamber; a plate that partitions the cooking chamber and the convection chamber; a carbon heater that is installed inside the convection chamber and includes a quartz tube and a carbon filament provided inside the quartz tube; a fixing member that elastically supports the carbon heater to the inside of the convection chamber; and a convection fan that is installed inside the convection chamber and forms a flow of air that convects heat of the carbon heater to the inside of the cooking chamber.

In further another embodiment, a cooker, comprising: a cavity that is provided with a cooking chamber; a convection chamber that is communicated with the cooking chamber; a carbon heater that is installed inside the convection chamber to generate heat and/or light transferred to the inside of the cooking chamber, having an end that penetrates through the convection chamber to be exposed to the outside of the convection chamber; a convection fan that is installed inside the convection chamber and forms a flow of air that convects heat of the carbon heater to the inside of the cooking chamber; and a power connecting unit that is connected to the end of the carbon heater that is exposed to the outside of the convection chamber to connect the carbon heater to power.

The details of one or more embodiments are set forth in the accompanying drawings and the description below. Other features will be apparent from the description and drawings, and from the claims.

DETAILED DESCRIPTION OF THE EMBODIMENTS

Hereinafter, a first embodiment of a cooker will be described with reference to the accompanying drawings.

Figure 1:
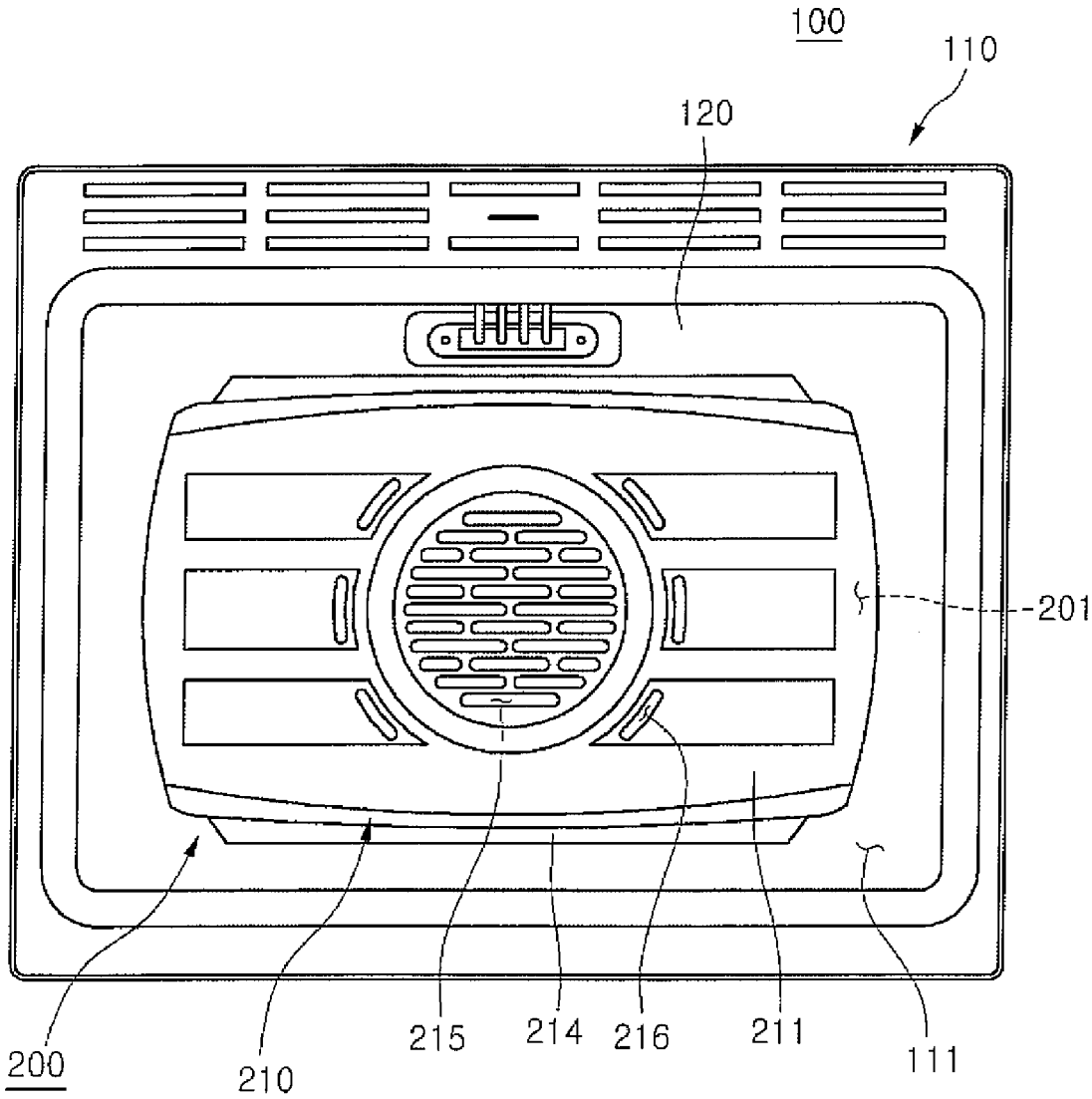
FIG. 1 is a front view showing a first embodiment.

FIG. 1 is a front view showing a first embodiment of a cooker.

Referring to FIG. 1, a cooking chamber 111 is provided inside a cavity 110 of an oven 100. In the cooking chamber 111, food is substantially cooked. The cooking chamber 111 is selectively opened/closed by a door (not shown). The door may open/close the cooking chamber 111 using a pull-down method that its upper end is rotated up and down by putting its lower end centering on the cavity 110.

A convection apparatus 200 is provided on a rear surface of the cooking chamber 111. The convection apparatus 200 serves to transfer heat and/or light to inside of the cooking chamber 111, thereby cooking food.

Figure 2:
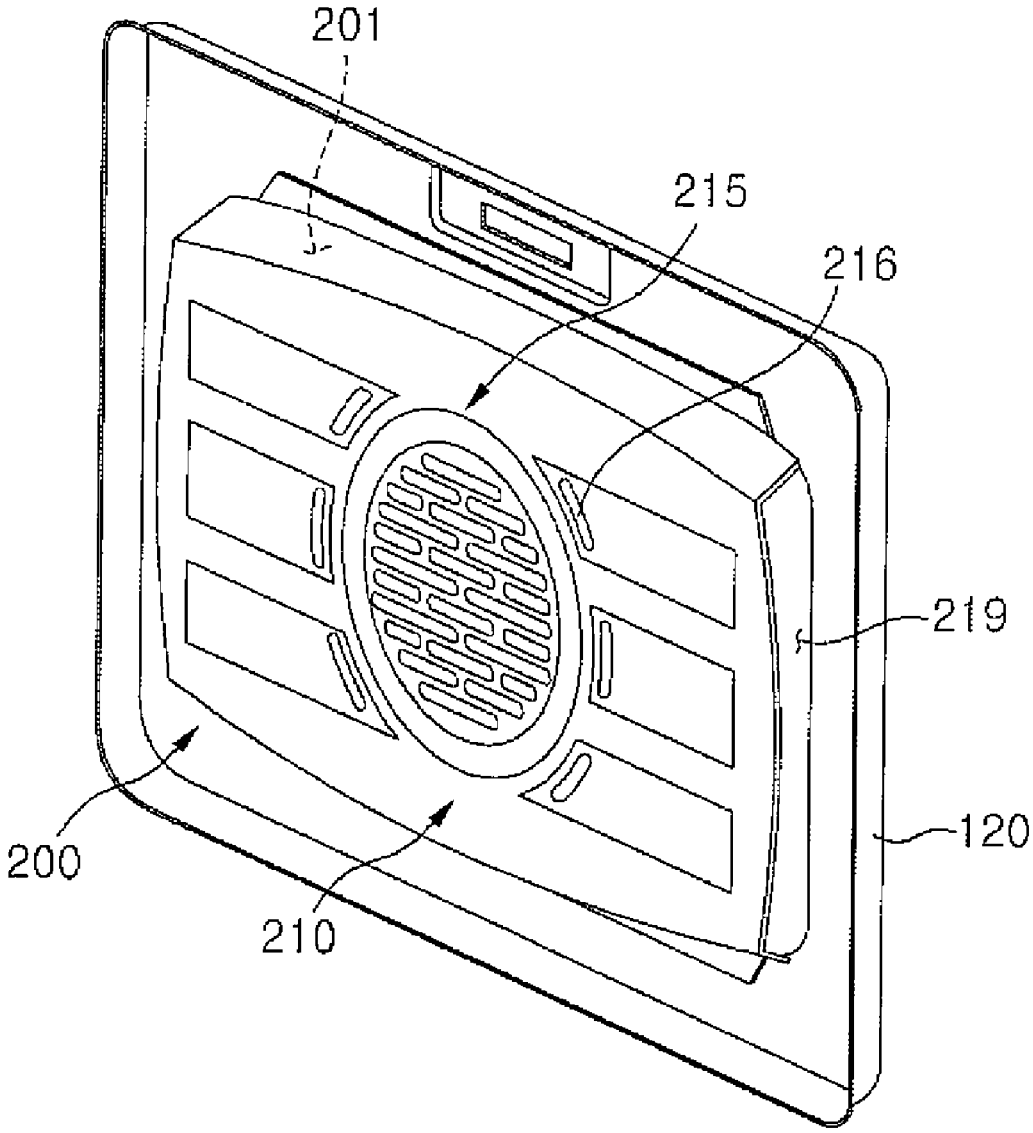
FIG. 2 is a perspective view showing a convection apparatus that constitutes the first embodiment.
Figure 3:
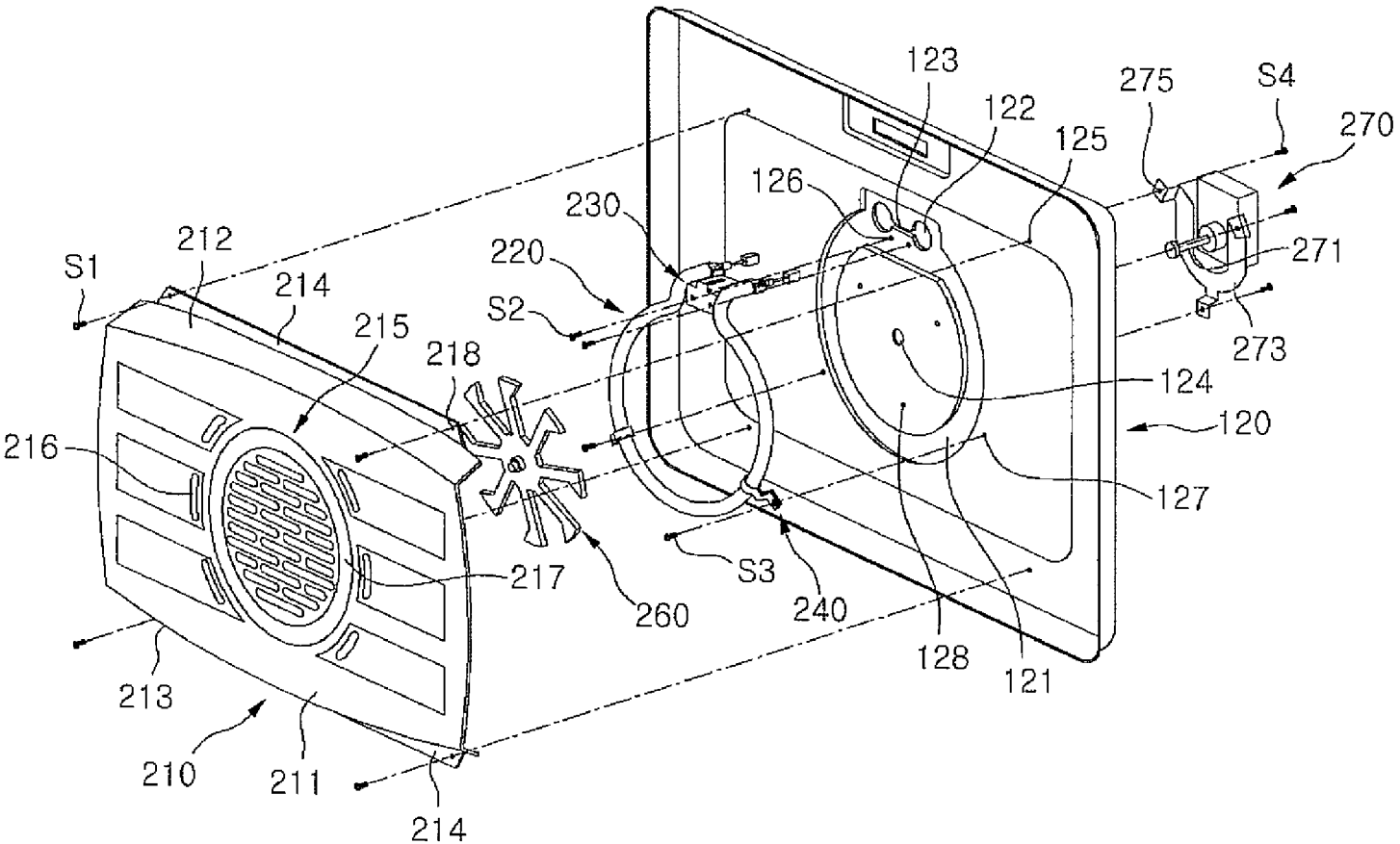
FIG. 3 is an exploded perspective view showing the convection apparatus that constitutes the first embodiment.
Figure 4:
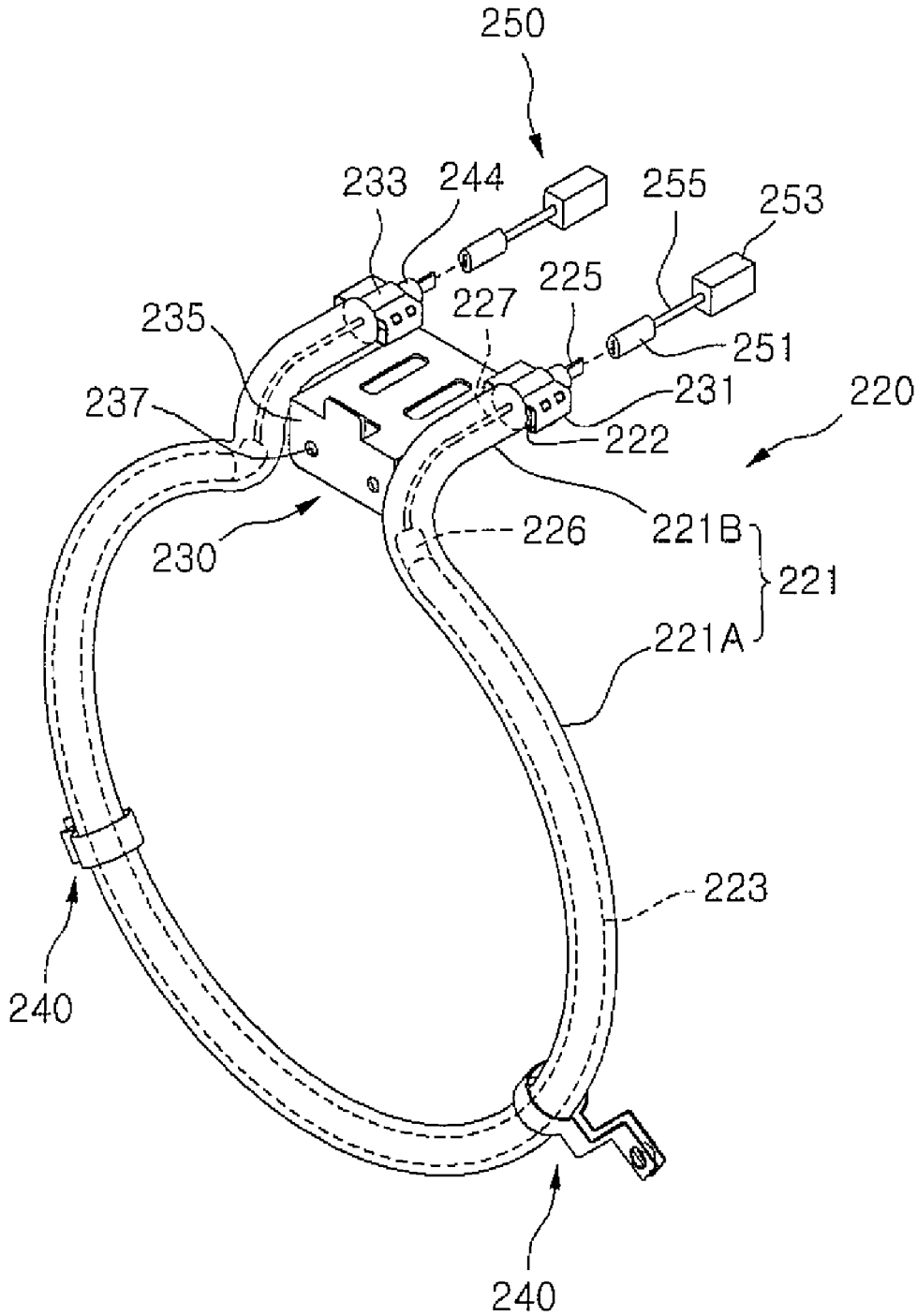
FIG. 4 is a perspective view enlarging a principal portion of the convection apparatus that constitutes the first embodiment.
Figure 5:
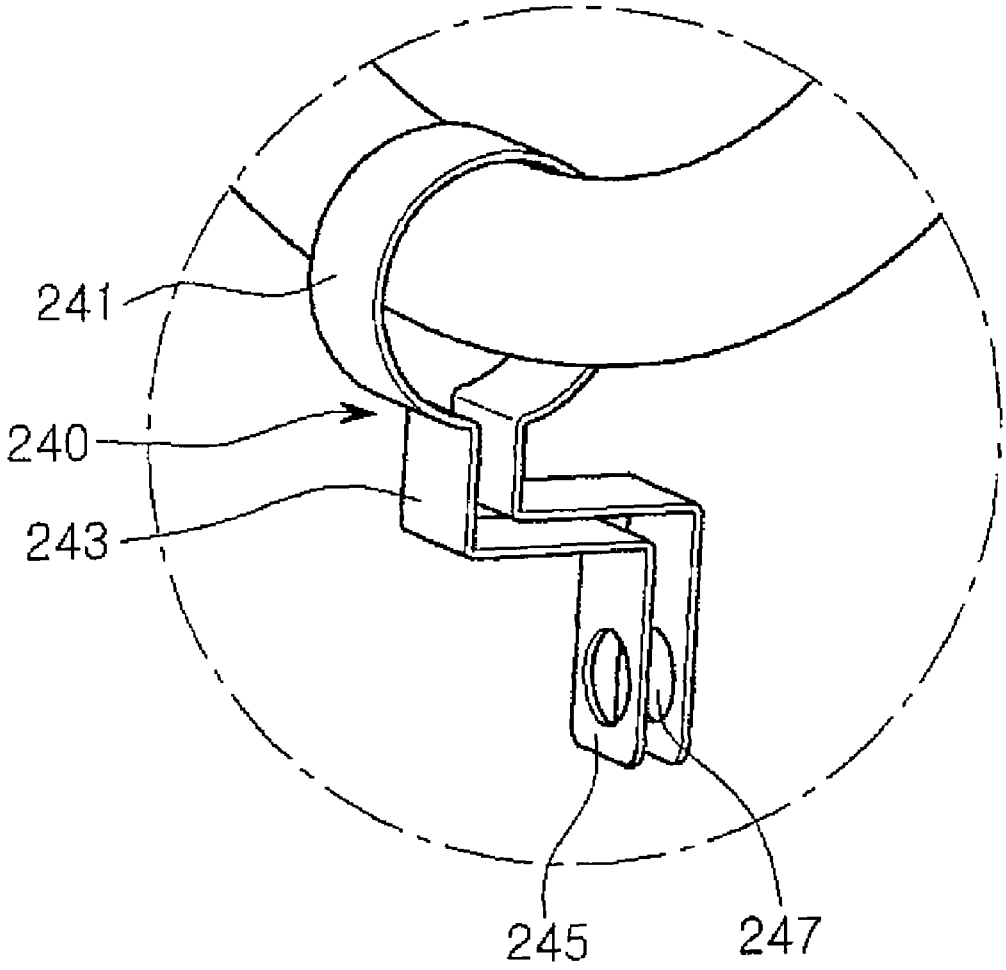
FIG. 5 is a perspective view enlarging another principal portion of the convection apparatus that constitutes the first embodiment.
Figure 6:
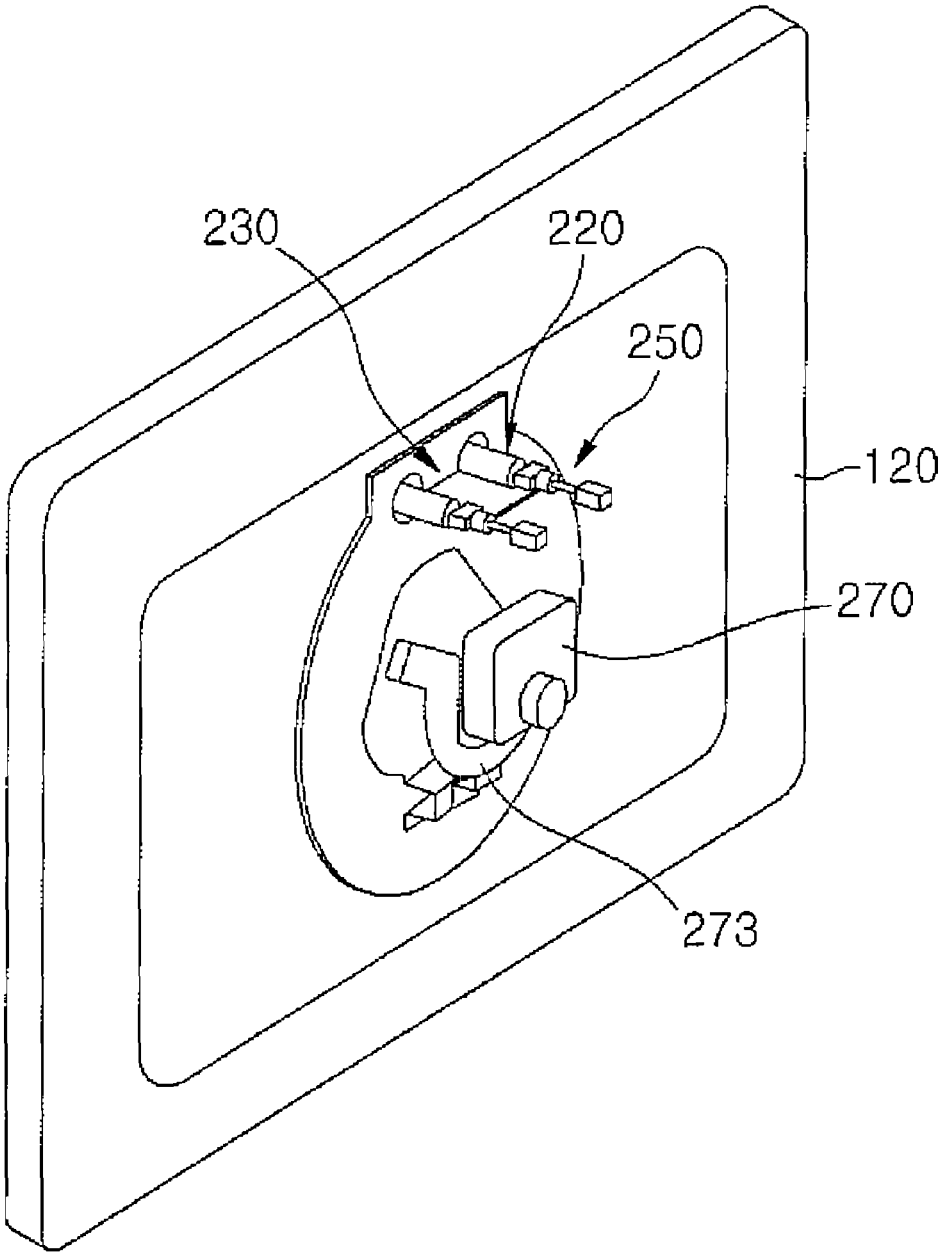
FIG. 6 is a perspective view showing the other surface of the convection apparatus that constitutes the first embodiment.

FIG. 2 is a perspective view showing a convection apparatus that constitutes the first embodiment, FIG. 3 is an exploded perspective view showing the convection apparatus that constitutes the first embodiment, FIG. 4 is a perspective view enlarging a principal portion of the convection apparatus that constitutes the first embodiment, FIG. 5 is a perspective view enlarging another principal portion of the convection apparatus that constitutes the first embodiment, and FIG. 6 is a perspective view showing the other surface of the convection apparatus that constitutes the first embodiment.

Referring to FIGS. 2 to 6, the convection apparatus 200 is configured to include a convection cover 210, a convection heater, a convection fan 260, and a convection motor 270. In the present embodiment, a carbon heater 220 is used as the convection heater. A detailed constitution of the carbon heater 220 will be described later.

The convection cover 210 forms a convection chamber 201 in which the carbon heater 220 and a convection fan 260 are installed. More specifically, the convection cover 210 is formed to be spaced forward, at a predetermined interval, from a front surface of a back plate 120 that forms a rear surface of the cooking chamber 111. Therefore, the convection chamber 210 is formed between the front surface of the back plate 120 and the other surface of the convection cover 210.

Referring to FIGS. 2 and 3, in the present embodiment, the convection cover 210 is configured to include a front surface part 211, an upper surface part 212, a lower surface part 213, and two flange parts 214. The front surface part 211 is formed in an approximately rectangular plate shape. The upper surface part 212 and the lower surface part 213 are extended from upper and lower ends of the front surface part 211 to be slanted upward and downward, respectively. In other words, in the present embodiment, it may be considered that the front surface part 211, the upper surface part 212, and the lower surface part 213 are entirely formed in a flat hexahedron shape that the rear surface and the both surfaces are opened. The flange parts 214 are extended upward or downward to be parallel to the front surface part 211 at front ends of the upper surface part 212 and the lower surface part 213, respectively. The flange parts 214 are adhered to the front surface of the back plate 120 to be fixed, respectively.

The convection cover 210 is formed with an inlet 215 and opening parts 216. The inlet 215 functions as an entrance that air inside the cooking chamber 111 is inhaled into the inside of the convection chamber 201. The opening parts 216 serve to transfer light and/or heat generated from the carbon heater 220 to the inside of the cooking chamber 111. The inlet 215 is formed by cutting a portion of the front surface part 211 corresponding to the convection fan 260, more specifically, a portion of the front surface part 211 corresponding to the inside of a projection of the carbon heater 220. Also, the opening parts 216 are formed by cutting a portion of the front surface part 211 corresponding to the outside of the projection of the carbon heater 220. This will be described again in the explanation on the carbon heater 220 and the convection fan 260. In the present embodiment, the inlet 215 entirely forms a circle configuration, and the opening parts 216 entirely form a ring configuration. However, the configurations of the inlet 215 and the opening part 216 are not limited thereto.

Referring to FIG. 3 again, first and second air guiding parts 121 and 217 are provided in the back plate 120 and the convection cover 210, respectively. The first and second air guiding parts 121 and 217 serve to allow air inhaled through the inlet 215 to more efficiently contact the carbon heater 220. In the present embodiment, the first air guiding part 121 is formed by recessing a portion of the back plate 120 backward, having a configuration corresponding to the projection of the carbon heater in the horizontal direction. The second air guiding part 217 is formed by recessing a portion of the front surface 211 backward, having a ring configuration with a diameter corresponding to the projection of the carbon heater 220. At this time, the first and second air guiding parts 121 and 217 are recessed having the same thickness, respectively. Therefore, the interval between a front surface of the first air guiding part 121 and the other surface of the second air guiding part 217 becomes the same as the front and rear interval of the convection chamber 201.

A plurality of first penetrating holes 218 are formed in the convection cover 210. More specifically, the first penetrating holes 218 are formed in both ends of the flange parts 214, respectively. A first engagement element S1 that fixes the convection cover 210 to the back plate 120 penetrates through the first penetrating hole 218.

Meanwhile, in the present embodiment, in a state where the flange parts 214 are adhered to the front surface of the back plate 120, the other surface of the front surface part 211 is spaced from the front surface of the back plate 120 at a predetermined interval. Therefore, an outlet 219 (see FIG. 2) that exhales air inside the carbon heater 220 to the inside of the cooking chamber 111 is formed on both sides of the convection chamber 201 corresponding to between the both ends of the front surface part 211 and the front surface of the back plate 120.

The back plate 120 is provided with two heater penetrating holes 122 and one bracket penetrating slot 123. The both ends of the carbon heater 220 penetrate through the heater penetrating holes 122. A heater bracket 230 that will be described later penetrates through the bracket penetrating slot 123. In the present embodiment, the heater penetrating holes 122 and the bracket penetrating slot 123 are formed by cutting a portion of the backplate so that they are communicated with each other.

A shaft penetrating hole 124 is formed in the back plate 120. A motor shaft that will be described later penetrates through the shaft penetrating hole 124.

In addition, first to fourth engaging holes 125, 126, 127, and 128 are formed in the back plate 120. The first engaging hole 125 is engaged with the first engagement element S1 that has penetrated through the first penetrating hole 218 for fixing the convection cover 210. The second and third engaging holes 126 and 127 are engaged with a second engagement element S2 and a third engagement element S3 for fixing a heater bracket 230 or a heater supporter 240, that will be described later, respectively. The fourth engaging hole 128 is engaged with a fourth engagement element S4 for fixing the convection motor 270.

The carbon heater 220 substantially serves to generate light and heat for cooking food in the cooking chamber 111. For example, as the carbon heater 220, a carbon heater such as a quartz heater including a tube and a heat line provided therein or a halogen heater may be used. Such a carbon heater is a heater with a relatively high output compared to a sheath heater that has been used as a convection heater in the related art.

The light generated from the carbon heater 220 is transferred to the inside of the cooking chamber 111 through the opening parts 216. The heat generated from the carbon heater 220 is transferred to the inside of the cooking chamber by convection, conduction, and radiation. More specifically, the light generated from the carbon heater 220 heats air circulating inside the cooking chamber 111 and the convection chamber 201, thereby being convected to the inside of the cooking chamber 111. In addition, a portion of the heat generated from the carbon heater 220 is conducted to the inside of the cooking chamber 111 through the convection cover 210. Furthermore, the rest of the heat generated from the carbon heater 220 is radiated to the inside of the cooking chamber 111 through the opening parts 216. As shown in FIG. 4, the carbon heater 220 is configured to include a tube 221, a filament 223, two insulating parts 224, two terminals 225, a connecting part 226, and two rods 227.

The tube 221 forms an external appearance of the carbon heater 220. As the tube 221, for example, a quartz tube approximately formed in a horseshoe or omega configuration may be used. More specifically, the tube 221 is configured to include a heating part 221A formed in an entirely circular opened curve and supporting parts 221B extended from both ends of the heating part 221A. The supporting parts 212B are positioned orthogonally to a virtual plane on which the heating part 221A is positioned. More specifically, the heating part 221A is positioned between the first and second air guiding parts 121 and 217. At this time, the virtual plane on which the heating part 221A is positioned is parallel to the front surface of the back plate 120 and the rear surface of the front surface part 211. The supporting parts 221B penetrate through the back plate 120, more specifically, the heater penetrating holes 122, respectively.

Pinch parts 222 are provided in the respective supporting parts 221B. The pinch parts 222 serve to fix both ends of the filament 223 and the insulating parts 224 simultaneously with sealing the inside of the tube 221.

Meanwhile, the filament is provided inside the tube 221. The filament 223 is applied with current, thereby substantially generating light and heat. As the filament 223, for example, a carbon filament may be used.

The insulating parts 224 serve to insulate both ends of the carbon heater 220. The insulating parts 224 are fixed by the pinch parts 222.

The terminals 225, the connecting part 226, and the rods 227 serve to supply current to the filament 223. To this end, the terminals 225 penetrate through the insulating parts 224 to be extended to the outside of the tube 221. The connecting part 226 is connected to both ends of the filament 223, respectively, and the rods 227 connect the terminals 225 to the connecting part 226.

The carbon heater 220 is fixed to the inside of the convection chamber 201 by one heater bracket 230 and at least one heater supporter 240. In the present embodiment, two heater supporters 240 are used for fixing the carbon heater 220, however, the heater supporter 240 of the number or more or the number or less may be used.

The heater bracket 230 substantially supports the supporting parts 221B. As shown in FIG. 4, the heater bracket 230 is configured to include two heater seating parts 231, two heater fixing parts 233, and one fixing rib 235.

The heater seating parts 231 are provided on both ends of the heater bracket 230. The supporting parts 221B including the pinch parts 224 are seated on the heater seating parts 231. The heater seating parts 231 are formed in a configuration corresponding to bottom surfaces of the supporting parts 221B including the pinch parts 224.

The heater fixing parts 233 prevents the supporting parts 221B being seated on the heater seating parts 231 from being optionally moved. The heater fixing parts 233 are adhered to upper surfaces of the pinch parts 224, in a state where the supporting parts 221B are substantially seated on the heater seating parts 231. For example, the heater fixing parts 233 are extended from both ends of the heater bracket 230, that is, outer ends of the heater seating parts 231, to outer ends, respectively. The heater fixing parts 233 may be banded to be adhered to the upper surfaces of the pinch parts 224, in a state where the supporting parts 221B are seated on the heater seating parts 231. The heater fixing parts 233 are molded separately from the heater seating parts 231 so that they may also be fixed to the heater seating parts 231.

The fixing rib 235 is provided in the rear end of the heater bracket 230. The fixing rib 235 fixes the heater bracket 230 to the front surface of the back plate 120. The fixing rib 235 is extended to be approximately orthogonal to a rear end of the heater bracket 230, thereby being adhered to the front surface of the back plate 120. A second penetrating hole 237 through which the second engagement element S2 penetrates is formed in the fixing rib 235.

The heater supporters 240 support the heating part 221A. The heater supporters 240 are formed by banding bars having a predetermined length in a predetermined configuration. The heater supporters 240 may be formed of metal material having a predetermined elasticity. The elasticity of the heater supporters 240 is to install and support the carbon heater 220. As shown in FIG. 5, one heater supporting part 241, two extending parts 243, and two fixing parts 245 are provided in the heater supporter 240.

The heater supporting part 241 is formed in a circular configuration having a larger diameter than that of the carbon heater 220. Both ends of the heater supporting part 241 are spaced from each other at a predetermined interval. The heating part 221A is positioned inside the heater supporting part 241. The reason why the diameter of the heater supporting part 241 has larger values than the diameter of the carbon heater 220 is to prevent a position of the heating part 221A from being moved, while minimizing contact between the heating part 221A and the heater supporting part 241. Therefore, with the heater supporting part 241, a phenomenon that the position of the heating part 221A is optionally moved can be prevented and at the same time, a phenomenon that the tube constituting the carbon heater 220 is damaged can be minimized.

The extending parts 243 are extended from both ends of the heater supporting part 241, respectively. The extending parts 243 substantially serve to elastically support the heating parts 225 that connect both ends of the heater supporting part 241 to the fixing parts 245, respectively. Therefore, in the present embodiment, the extending parts 243 are formed in a letter L configuration to be spaced from each other at a predetermined interval, however, the configuration of the extending parts 243 is not limited thereto.

The fixing parts 245 are extended from one end of the extending parts 243, respectively. Therefore, the fixing parts 245 will also be spaced from each other at a predetermined interval in the same manner of the extending parts 243. The fixing parts 245 fix the heater supporter 240 to an inner side of the rear surface of the cooking chamber 111. To this end, a third penetrating hole 240 through which the third engagement element S3 that is engaged with the third engaging hole 127 penetrates is formed in the fixing part 245.

Meanwhile, the carbon heater 220 receives power by a power connecting unit 250. As shown in FIG. 4, the power connecting unit 250 is configured to include a first connector 251, a connector 253, and a lead wire 255.

The first connector 251 is connected to the terminal 225, and the second connector is connected to a power unit (not shown) of the oven 100. The second connector 253 may be directly connected to the power unit or may be connected to a separate connecting member that is connected to the power unit, for example, a socket, etc. And, the lead wire 255 connects the first and second connectors 251 and 253. Meanwhile, the carbon heater 220 is installed, that is, the carbon heater 220 is fixed to the inside of the convection chamber 201 by the heater bracket 230 and the heater supporter 240, after the power connecting unit 250 is connected to the carbon heater 220. In other words, in a state where the first connector 251 is connected to the terminal 225, the carbon heater 220 penetrates through the heater penetrating hole 122.

Referring to FIG. 3 again, the convection fan 260 is positioned inside the convection chamber 201 to be positioned inside the carbon heater 220, more specifically, inside the projection of the heating part 221A in the horizontal direction. In other words, the carbon heater 220 is positioned to be adjacent to the outer periphery of the convection fan 260. The convection fan 260 forms a flow of air where air inside the cooking chamber 111 is inhaled into the inside of the convection chamber 501 through the inlet 215 and air inside the convection chamber 201 heated by the carbon heater 220 is discharged to the inside of the cooking chamber 111 through the outlet 219.

In addition, the convection motor 270 is installed in the rear surface of the back plate 120. The convection motor 270 provides driving force for rotating the convection fan 260. To this end, a motor shaft 271 is provided in the convection motor 270. The motor shaft 271 penetrates through the shaft penetrating hole 124 to be projected to the inside of the convection chamber 201, thereby being coupled to the convection fan 260. The convection motor 270, being mounted on the motor bracket 283, is fixed to the rear surface of the back plate 120. A fourth penetrating hole 275 to which the fourth engagement element S4 that is engaged with the fourth engaging hole 128 penetrates is formed in the motor bracket 273.

Hereinafter, a process to manufacture the first embodiment of the cooker will be described in more detail.

First, a convection motor 270 is installed in a rear surface of a back plate 120. The convection motor 270, being mounted on the motor bracket, is installed as a fourth engagement element S4 penetrating through a fourth penetrating hole 275 of the motor bracket 273 is engaged with a fourth engaging hole 128 of the back plate 120. At this time, a motor shaft 271 of the convection motor 270 penetrates through a shaft penetrating hole 124 of the back plate 120. A convection fan 270 is coupled to a front end of the motor shaft 271. The fixing of the convection motor 270 and the coupling of the convection fan 260 may be made after a carbon heater to be described later is fixed.

Next, a first connector 251 of a power connecting unit 250 is connected to a terminal of a carbon heater 220. And the carbon heater 220 is fixed to the front surface of the back plate 120 using a heater bracket 230 and heater supporters 240. More specifically, the heater supporters 240 are positioned on a heating part 221A of the carbon heater 220 through supporting parts 221B of the carbon heater 220. Next, the supporting parts 221B of the carbon heater 220 are seated on heater seating parts 231 of the heater bracket 230. Then, heater fixing parts 233 of the heater bracket 230 are banded, thereby fixing the supporting parts 221B to the heater bracket 230.

In this state, the supporting parts 221B are penetrated through heater penetrating holes 122 of the back plate 120. At this time, the heater seating parts 231 and the heater fixing parts 233 to which the supporting parts 221B are fixed penetrate through the heater penetrating holes 122 or a bracket penetrating slot 123, respectively. A fixing rib 235 of the heater bracket 230 is also adhered to a front surface of the back plate 120. A second engagement element S2 penetrates through a second penetrating hole 238 of the heater bracket 230 to be engaged with a second engaging hole 126 of the back plate 120, thereby fixing the heater bracket 230 to the back plate 120.

Next, the heater supporter 240 is moved to be positioned on a predetermined position that is designed, that is, a position where a third penetrating hole 247 of the heater supporter 240 is communicated with a third engaging hole 127 of the back plate 120. Then, a third engagement element S3 penetrated through the third penetrating hole 247 of the heater supporter 240 is engaged with the third engaging hole 127 of the back plate 120, thereby fixing the heater supporter 240.

Meanwhile, a second connector 253 of the power connecting unit 250 is connected to a socket connected to the power unit. Therefore, current can be applied to the carbon heater 220 by the power connecting unit 250.

Finally, a convection cover 210 is fixed to the back plate 120. More specifically, flange parts 214 of the convection cover 210 are adhered to a front surface of the back plate 120. At this time, a first penetrating hole 218 of the convection cover 210 is positioned to be communicated with a first engaging hole 125 of the back plate 120. A first engagement element S1 penetrating through a first penetrating hole 218 of the convection cover 210 is engaged with the first engaging hole 125 of the back plate 120, thereby fixing the convection cover 210 to the back plate 120.

Next, a flow of air inside the cooking chamber in the first embodiment will be described in more detail with reference to the accompanying drawings.

Figure 7:
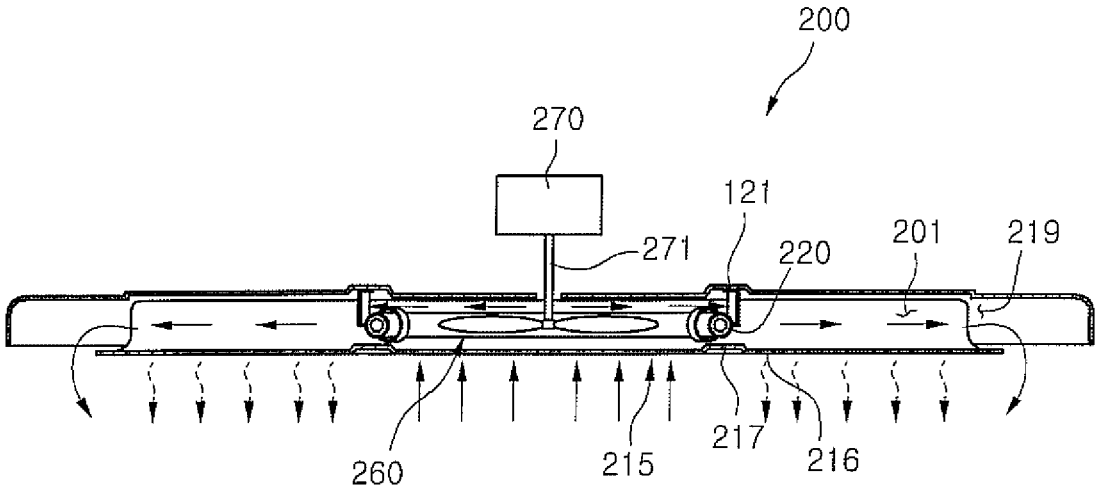
FIG. 7 is a horizontal cross-sectional view showing a flow of air inside a cooking chamber in the first embodiment.

FIG. 7 is a horizontal cross-sectional view showing a flow of air inside a cooking chamber in the first embodiment.

Referring to FIG. 7, if a user inputs an operation signal in order to cook food in a cooking chamber 111 using a convection apparatus 200, the carbon heater 220 is turned on to be operated. At the same time, if a convection motor 270 is driven, a convection fan 260 is rotated thereby. If the convection fan 260 is rotated, air inside the cooking chamber 111 is inhaled to the inside of the convection chamber 201 through an inlet 215.

The air inhaled into the inside of the convection chamber 201 contact the carbon heater 220 to be heated. However, in the present embodiment, air inhaled through the inlet 215 by air guiding parts 121 and 217 more efficiently contacts the carbon heater 220. More specifically, a flow of the air inhaled through the inlet 215 to be flowed inside the convection chamber 201 is interfered by the air guiding parts 121 and 217, increasing a contact area with the carbon heater 220. Therefore, the air flowing inside the convection chamber 201 can be more efficiently heated by the carbon heater 220.

The air heated by the carbon heater 220 as described above is discharged to the inside of the cooking chamber 111 through an outlet 219 by a continuous driving of the convection fan 260. Therefore, heat generated from the carbon heater 220 is convected to the inside of the cooking chamber 111, thereby heating food.

Meanwhile, a portion of the heat generated from the carbon heater 220 is conducted to the inside of the cooking chamber 111 or is directly radiated to the inside of the cooking chamber 111 through an opening part 216. Therefore, the heat generated by the carbon heater 220 is conducted and radiated to the inside of the cooking chamber 111 so that it may also cook food inside the cooking chamber 111.

In addition, if the carbon heater 220 is operated, light is also generated. The light of the carbon heater 220 as above is transferred to the inside of the cooking chamber 111 through the opening part 216. Therefore, by the light of the carbon heater 220, the food inside the cooking chamber 111 may be heated or the user may easily distinguish whether the convection apparatus 200 is operated.

Figure 8:
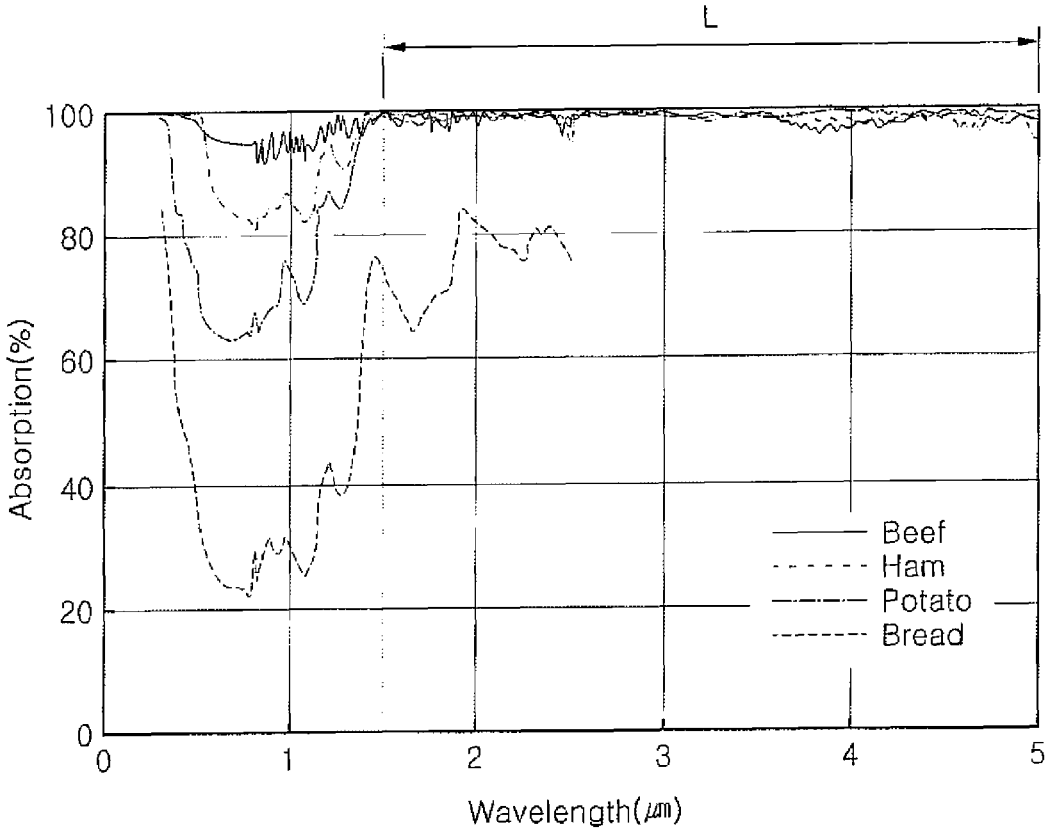
FIG. 8 is a graph showing energy absorption rate for each subject to be cooked according to wavelength.
Figure 9:
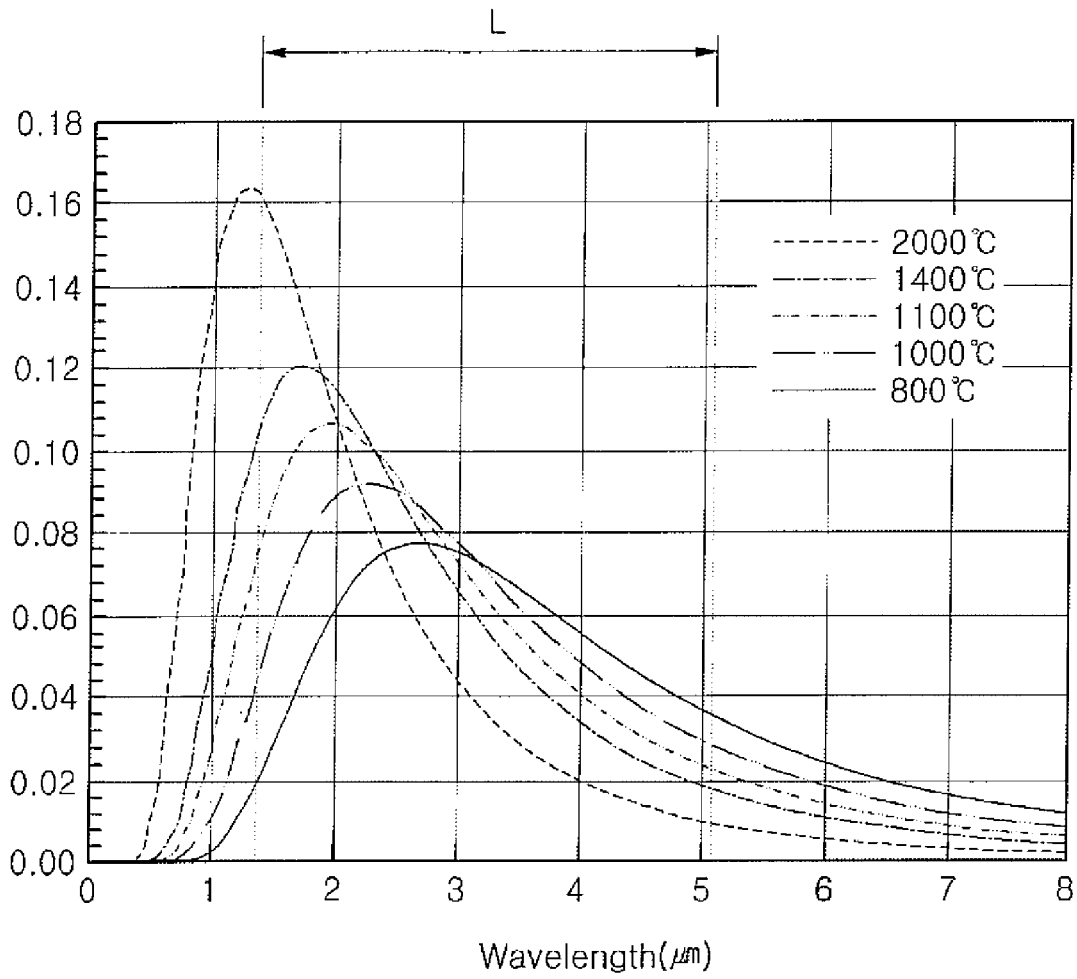
FIG. 9 is a graph showing radiant spectrum for each wavelength according to temperature.
Figure 10:
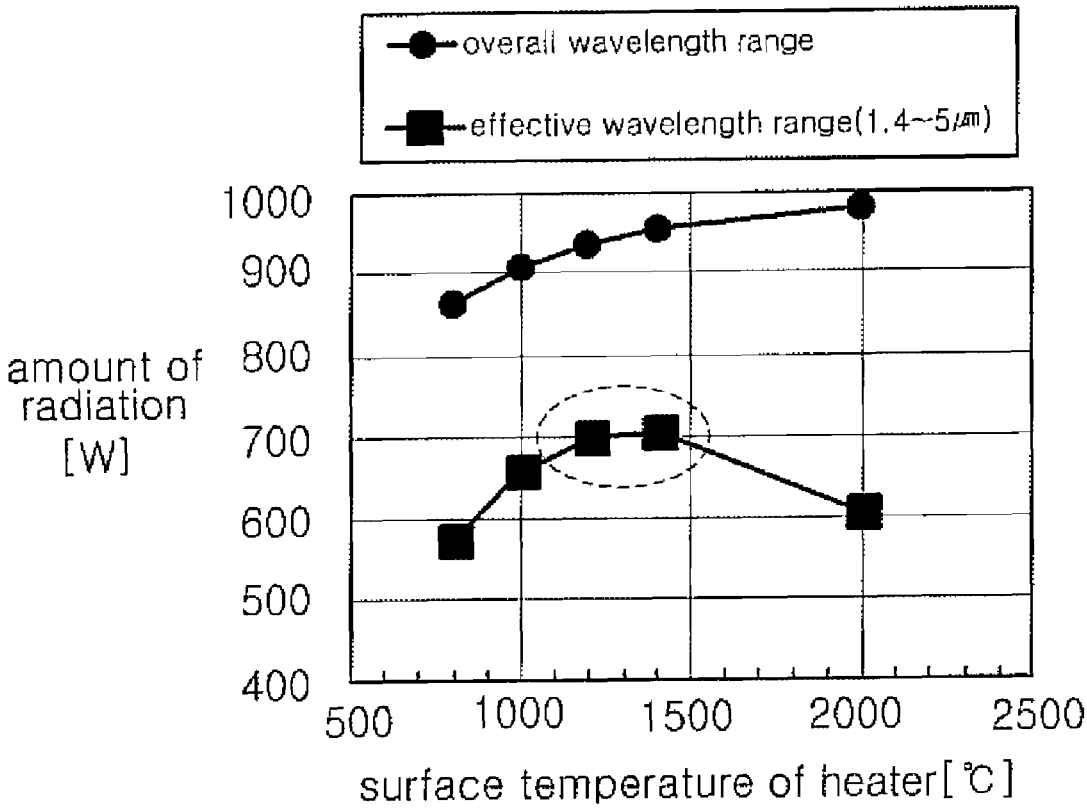
FIG. 10 is a graph showing radiation according to surface temperature of a heater.
Figure 11:
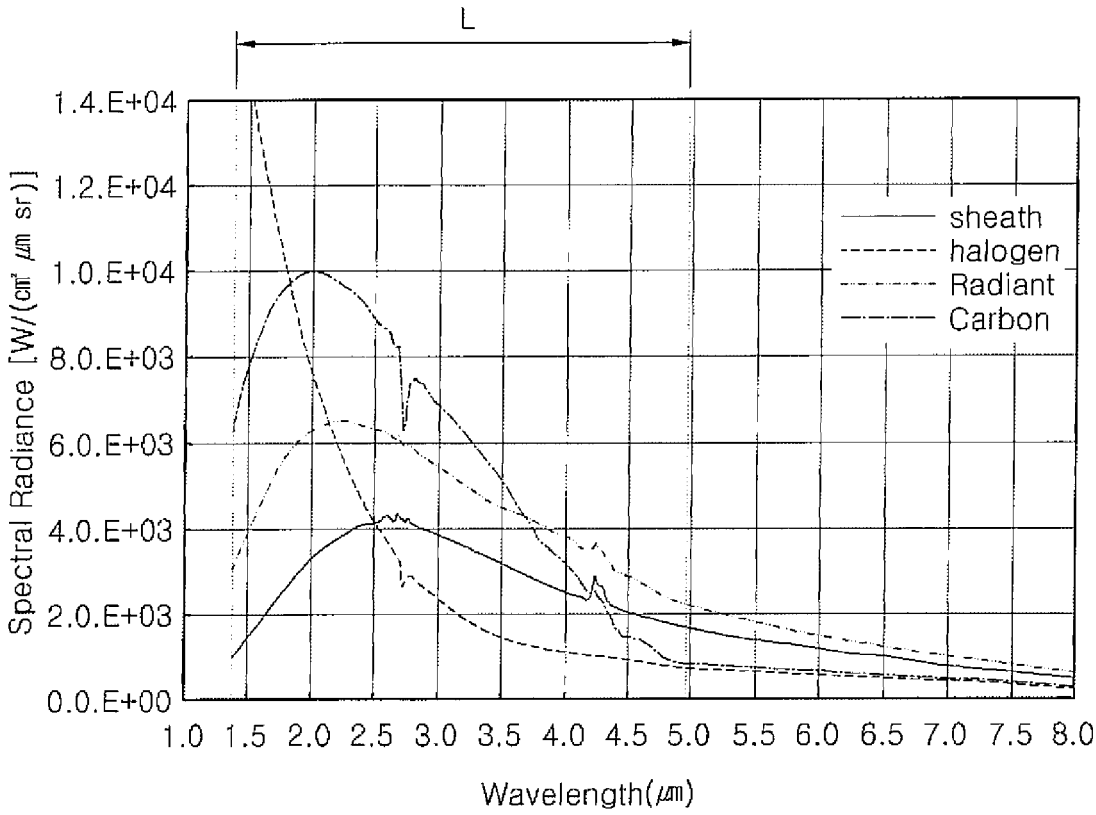
FIG. 11 is a graph showing radiance according to wavelength of a carbon heater and a halogen heater.

FIG. 8 is a graph showing energy absorption rate for each subject to be cooked according to wavelength, FIG. 9 is a graph showing radiant spectrum for each wavelength according to temperature, FIG. 10 is a graph showing radiation according to surface temperature of a heater, and FIG. 11 is a graph showing radiance according to wavelength of a carbon heater and a halogen heater.

Referring to FIG. 8, after making an experiment on main food such as beef, ham, potato, bread, etc., it can be appreciated that wavelengths of about 1.4 to 5μ having good energy absorption rate of the main food to be cooked are a valid effective wavelength band of the main cook. In the present embodiment, as described above, the carbon heater 11 provides energy of an effective wavelength band where the food inside the cooking chamber 511 is most efficiently cooked among effective wavelength bands below the effective wavelength band to the inside of the cooking chamber 511. Therefore, more efficient cook can be made according to the sorts of food inside the cooking chamber 511.

Next, referring to FIGS. 9 and 10, as a heater having a lot of radiation in the wavelength band of about 1.4 to 5μ that is the valid effective wavelength band of the main food to be cooked, it can be appreciated that a heater having a heater surface temperature of about 100 to 1400□ is advantageous. More specifically, referring to FIG. 9, it can be appreciated that energy of wavelength included in the effective wavelength band is the largest in a temperature zone of 100 to 1400□, and referring to FIG. 10 that is understood as graph integrating FIG. 9 for each wavelength, it can be directly appreciated that energy of the effective wavelength band is the largest in a temperature zone of 100 to 1400□. In addition, referring to FIG. 11, it can be appreciated that a carbon heater has more radiation than other heaters, in particular, a halogen heater, in the effective wavelength band (about 14. to 5μ) of the main food.

In other words, it can be appreciated that the carbon heater 11 can substantially be more efficiently used in cooking food than other heaters, that is, a sheath heater, a halogen heater, and a radiant heater.

Meanwhile, [Table 1] below represents heater surface temperatures, temperature rising widths, and power consumption costs according to the sorts of food.

TABLE 1

| | | | Halogen heater | Ceramic heater | Sheath heater | Carbon heater |
|---|---|---|---|---|---|---|
| Heater surface temperature (□) | | | 2000 | 1000 | 900 | 1200 |
| Temperature rising (□t□), 1200 | Subject to be cooked (Cooking time) | Steak (15 min.) | 31.6 | 24.2 | 23.1 | 26.7 |
| | | Ham (10 min.) | 27.5 | 24.9 | 23.7 | 30.4 |
| | | Potato (15 min.) | 37.0 | 516.8 | 29.2 | 44.0 |
| | | Bread (4 min.) | 8.1 | 22.8 | 5.1 | 26.3 |
| Power consumption costs (\/1 KW) | | | 8500 | | | 8000 |

Referring to Table 1, it can be appreciated that the carbon heater 11 has a higher temperature rising width that those of other heaters at the time of heating and cooking the main food. In other words, the carbon heater 11 generates a relatively large amount of energy of the effective wavelength band, thereby proving that the relatively large amount of energy is used in cooking food. In addition, if the relatively large amount of energy is used in cooking food, the cooking time of the food is shorten, making it possible to improve cooking efficiency thereby and further making it possible to naturally expect an advantage that energy consumption efficiency of the cooker is raised.

An inventor of the present invention could find that a wavelength where the radiant energy emitted from the carbon heater is maximized is 1.5~2.5 μm through a plurality of experimental tests as long as the carbon heater is adequately operated.

Hereinafter, a second embodiment of the cooker will be described in more detail with reference to the accompanying drawings.

Figure 12:
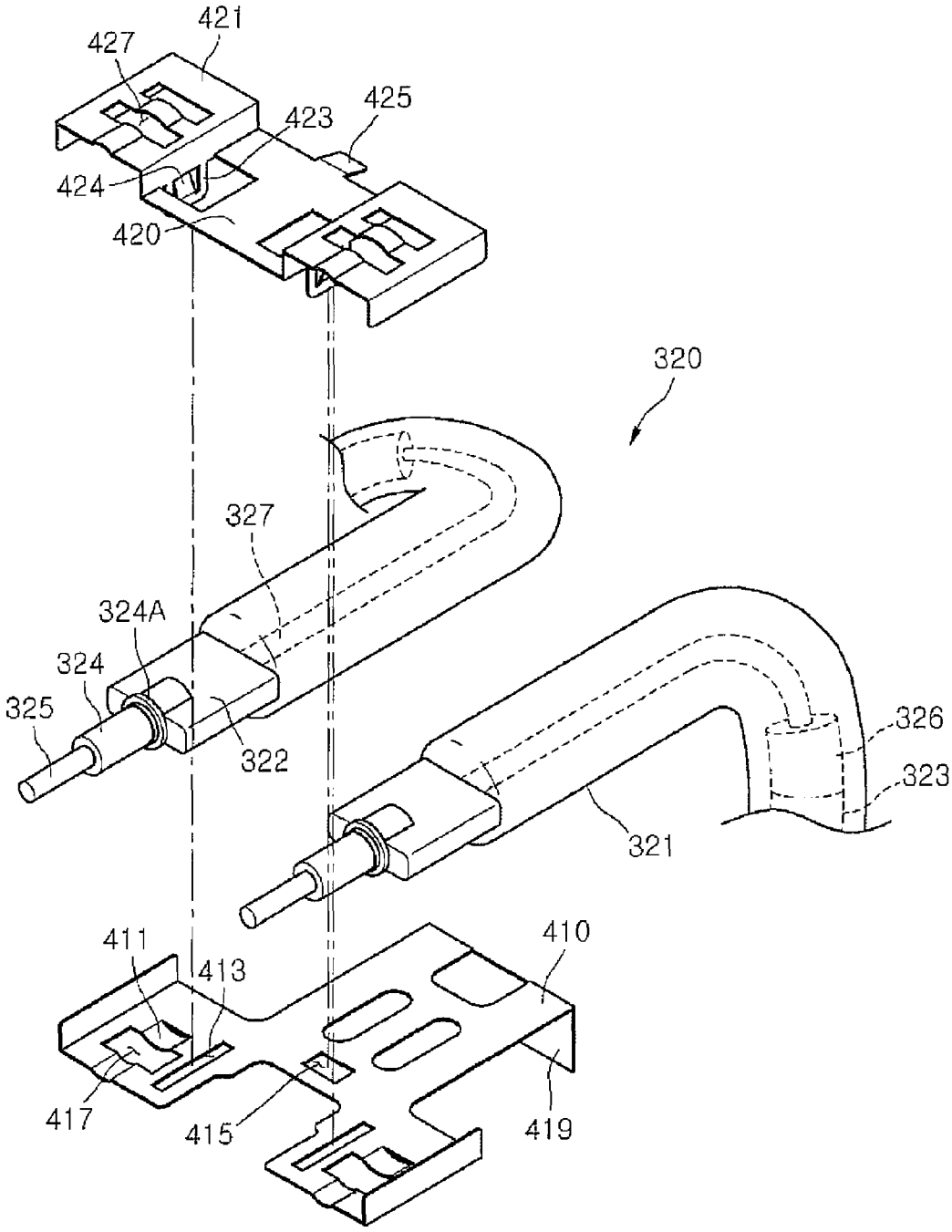
FIG. 12 is an exploded perspective view showing a principal portion of a convection apparatus that constitutes a second embodiment.

FIG. 12 is an exploded perspective view showing a principal portion of a convection apparatus that constitutes a second embodiment. Among the elements of the present embodiment, the detailed description on the same elements as those of the first embodiment.

Referring to FIG. 12, in the present embodiment, a carbon heater 320 used as a convection heater is configured to include a tube 321, a filament 323, two insulating parts 324, tow terminals 325, a connecting part 326, and two rods 327. The tube 321, the filament 323, the insulating parts 324, the terminals 325, and the rods 327 that constitute the carbon heater 320 are the same as those in the first embodiment.

However, in the present embodiment, hooking projections 324A are provided in outer circumferential surfaces of the insulating parts 324. The hooking projections 324A are formed as portions of the insulating parts 324 are radiantly projected. In the present embodiment, a heater bracket 400 that supports both ends of the carbon heater 320 is constituted using two members.

More specifically, the heater bracket 400 is to support both ends of the carbon heater 320 that are extended to the outside of the cooking chamber 111, substantially, both ends of the tube 321, in particular, the pinch part 322. The heater bracket 400 is configured to include first and second heater supporting parts 410 and 420. The first and second heater supporting parts 410 and 420 are fixed to each other, surrounding the pinch part 322, thereby supporting the carbon heater 320.

More specifically, adhering parts 411 that are formed in a configuration corresponding to a lower configuration of an outer circumferential surface of the pinch part 322 are formed in the first heater supporting part 410. Therefore, the adhering parts 411 of the first heater supporting part 410 are spaced from each other by an interval of the pinch part 322.

Two first fixing slots 413 and one second fixing slot 415 are provided in the first heater supporting part 410. The first fixing slots 413 are formed as portions of the first heater supporting parts 410 adjacent to the adhering parts 411 of the first heater supporting part 410 are cut. The second fixing slot 415 is also formed as a portion of the first heater supporting part 410 is cut to be spaced from the first fixing slots 413 in a vertical direction to both ends of the tube 321.

In addition, two hooking holes 417 are formed in the first heater supporting part 410. The hooking holes 417 of the first heater supporting part 410 are formed as portions of the first heater supporting part 410 corresponding to the tops of the adhering parts 411 of the first heater supporting part 410 are cut. In a state where the pinch part 322 is adhered to the adhering parts 411 of the first heater supporting part 410, the hooking projections 324A are positioned on the hooking holes 417 of the first heater supporting part 410.

A fixing part 419 is provided in the first heater supporting part 410. The fixing part 419 fixes the first heater supporting part 410 to one side of the cooking chamber 111. To this ends the fixing part 419 is formed as a portion of the first heater supporting part 410 corresponding to an opposite side of the adhering parts 4100 of the first heater supporting part 410 is bent to the rest portions thereof. The fixing part 419 is fixed in a state it is adhered to an outer side of the rear surface of the cooking chamber 111. At least one penetrating hole (not shown) is formed in the fixing part 419. The penetrating hole is a portion to which an engagement element (not shown) that fixes the fixing part 419 to the rear surface of the cooking chamber 111 penetrates.

Adhering parts 421 are also provided in the second heater supporting part 420. The adhering parts 421 of the second heater supporting part 420 are also formed in a configuration corresponding to an upper configuration of an outer circumferential surface of the pinch part 322.

Two first fixing ribs 423 and one second fixing rib 425 are provided in the second heater supporting part 420. The first fixing ribs 423 are extended approximately orthogonally to the adhering parts 421 of the second heater supporting part 420. The second fixing rib 425 are extended to an outer side of the second heater supporting part 420 to be parallel to the adhering parts 421 of the second heater supporting part 420. The first and second fixing ribs 423 and 425 are inserted into the first and second fixing slots 415, respectively, in a state where the pinch part 322 is adhered to the adhering parts 421 of the second heater supporting part 420. Furthermore, hooking ribs 424 are provided in the first fixing ribs 423. The hooking ribs 424 serve to prevent the first fixing ribs 423, being inserted into the first fixing slots 413, from being optionally detached. In the present embodiment, the hooking ribs 424 are bent at a predetermined angle as portions of the first fixing ribs 423 are cut, thereby being elastically deformed while the first fixing ribs 423 are inserted into the first fixing slots 413.

In addition, hooking holes 428 are also provided in the second heater supporting part 420. The hooking holes 427 of the second heater supporting part 420 is formed as portions of the second heater supporting part 420 corresponding to the tops of the adhering parts 421 of the second heater supporting part 420 are cut. The hooking projections 324A are also positioned in the hooking holes 427 of the second heater supporting part 420, in the same manner as the hooking holes 417 of the first heater supporting part 410.

Hereinafter, effects of the second embodiment of the cooker will be described in more detail.

First, both ends of the carbon heater 320, more specifically, both ends of a tube 321, in particular, a pinch part 322, are seated on a first heater supporting part 410. Therefore, lower portions of an outer circumferential surface of the pinch part 322 are adhered to adhering parts 411 of the first heater supporting part 410. At this time, hooking projections 324A of insulating parts 324 are positioned in hooking holes 417 of the first heater supporting part 410.

In the state, a second fixing rib 425 is inserted into a second fixing slot 415 by moving the second heater supporting part 420 in an approximately horizontal direction. The second heater supporting part 420 is rotated centering on the second fixing rib 425 inserted into the second fixing slot 415. Therefore, first fixing ribs 423 are inserted into first fixing slots 413. Meanwhile, hooking ribs 424 are elastically deformed while the first fixing ribs 423 are inserted into the first fixing slots 413. If the first fixing ribs 423 are completely inserted into the first fixing slots 413, one side of the hooking rib 424 is hooked by one side of the first heater supporting part 410, thereby preventing the first fixing ribs 423 from being detached optionally from the first fixing slots 413.

In addition, an upper portion of an outer circumferential surface of the pinch part 322 is adhered to the adhering part 421 of the second heater supporting part 420 simultaneously with inserting the first fixing ribs 423 into the first fixing slots 413. The hooking projections 324A are positioned in hooking holes 427 of the second heater supporting part 420.

As described above, if the second heater supporting part 420 is fixed to the first heater supporting part 410, the outer circumferential surface of the pinch part 322 is adhered to the adhering parts 421 of the first and second heater supporting parts 410 and 420, thereby limiting the movement thereof in the diameter direction of the outer circumferential surface of both ends of the tube 321. Furthermore, the hooking projections 324A are positioned in the hooking holes 417 and 427 of the first and second heater supporting parts 410 and 420, thereby limiting the movement thereof in the vertical direction to both ends of the tube 321.

Meanwhile, in a state where the pinch part 322 is surrounded and fixed by the first and second heater supporting parts 410 and 420, both ends of the carbon heater 320 and the first and second heater supporting parts 410 and 420 are penetrated through the rear surface of the cooking chamber 111. Then, the fixing part 419 is fixed to an inner side of the rear surface of the cooking chamber 111. Therefore, the first and second heater supporting parts 410 and 420, that is, the heater bracket 400, are substantially fixed to the rear surface of the cooking chamber 111.

Hereinafter, a third embodiment of the cooker will be described in more detail with reference to the accompanying drawings.

Figure 13:
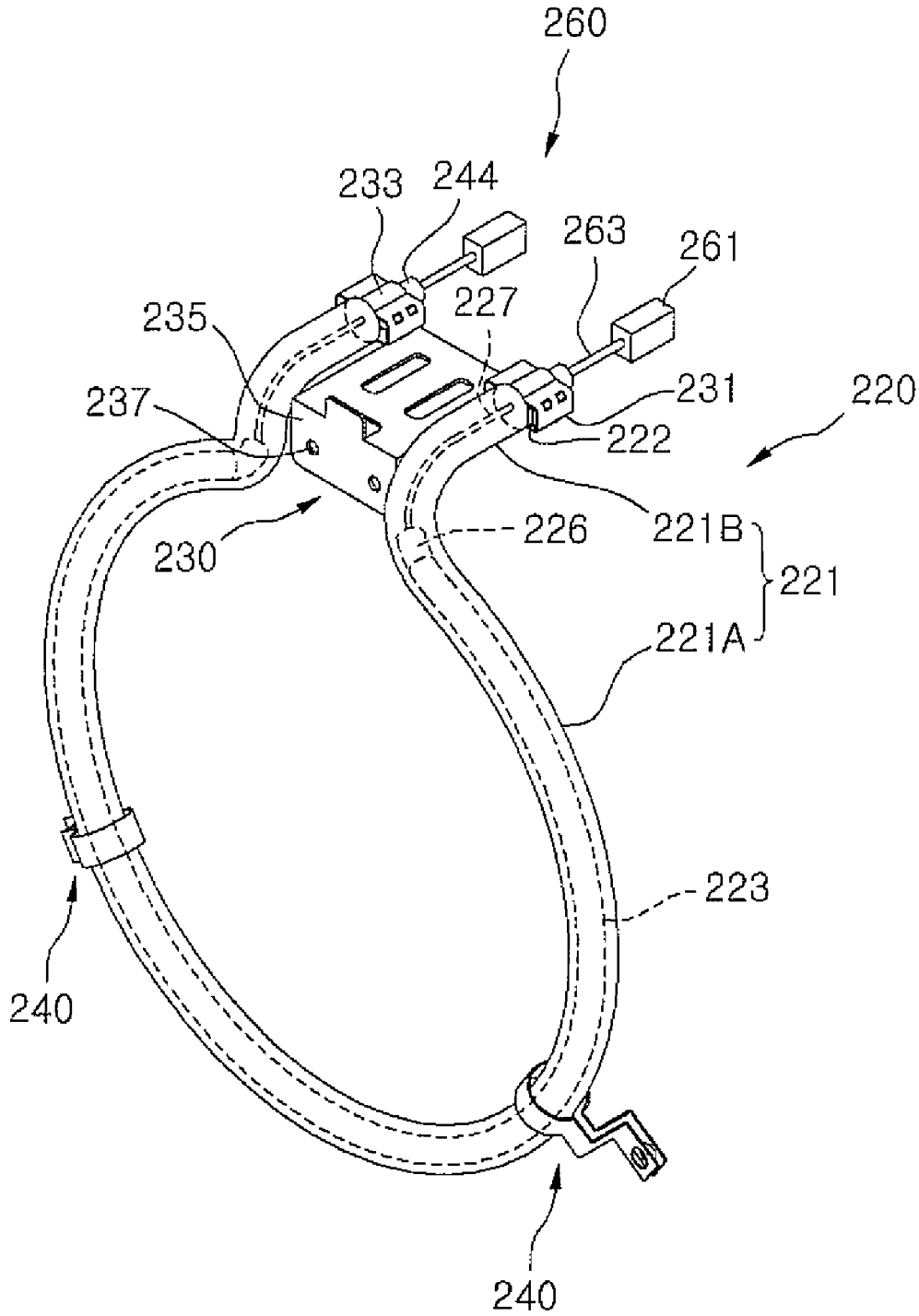
FIG. 13 is a perspective view enlarging a principal portion of the convection apparatus that constitutes the third embodiment.

FIG. 13 is a perspective view enlarging a principal portion of the convection apparatus that constitutes the third embodiment. Among the elements of the present embodiment, the detailed description on the same elements as those of the first embodiment will be omitted.

Referring to FIG. 13, a power connecting unit 260 is configured to include a connector 261, and a lead wire 263.

The connector 261 is connected to a power unit (not shown) of an oven 100. The connector 261 may be directly connected to the power unit or may be connected to a separate connecting member that is connected to the power unit, for example, a socket, etc. And, the lead wire 263 connects a carbon heater 220 and the connector 261. Namely, an end of the lead wire 263 is directly connected to the carbon heater 220, and other end of the lead wire 263 is connected to the connector 261. Meanwhile, the carbon heater 220 is installed, that is, the carbon heater 220 is fixed to the inside of a convection chamber 201 by a heater bracket 230 and a heater supporter 240, after the power connecting unit 260 is connected to the carbon heater 220.

Hereinafter, a fourth embodiment of the cooker will be described in more detail with reference to the accompanying drawings.

Figure 14:
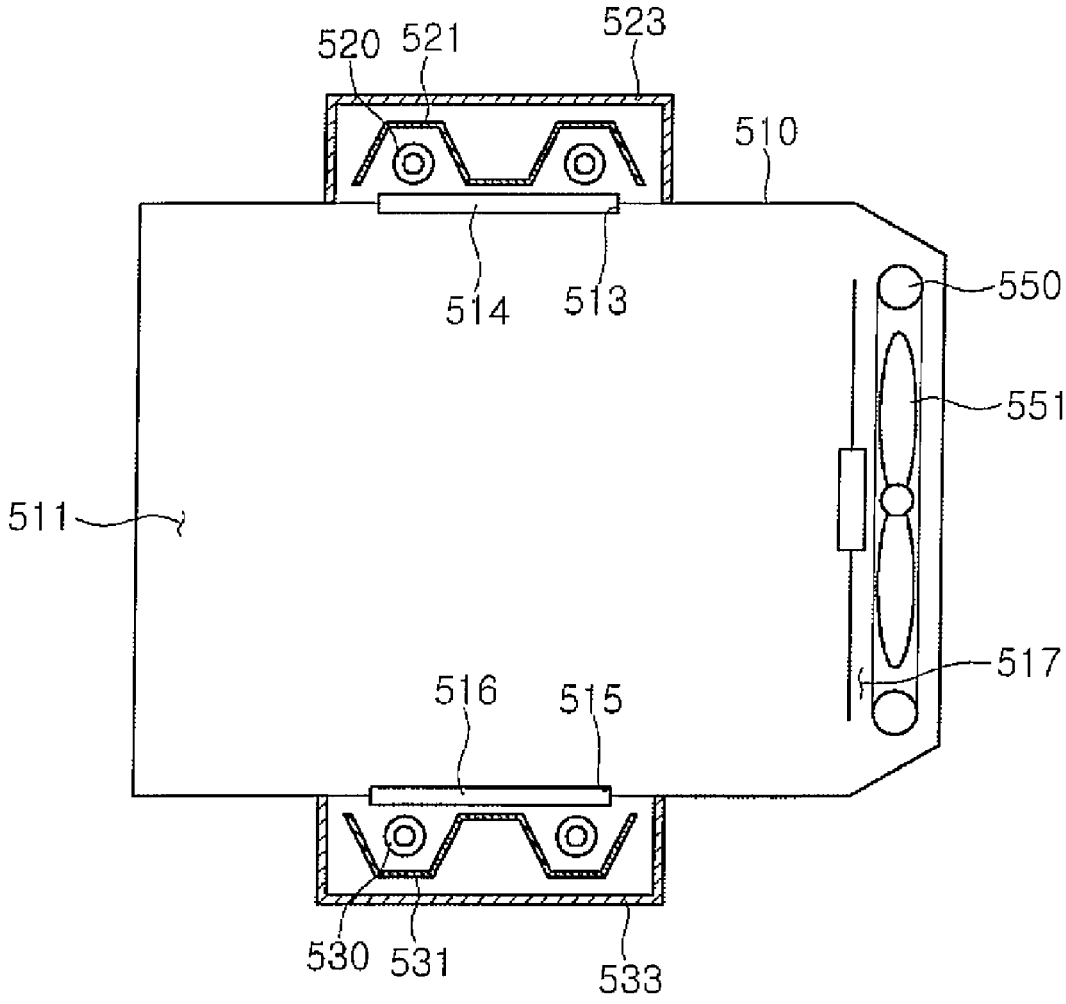
FIG. 14 is a vertical cross-sectional view schematically showing a fourth embodiment.

FIG. 14 is a vertical cross-sectional view schematically showing a fourth embodiment.

Referring to FIG. 14, a cooking chamber 511 is provided inside a cavity 510. Opening parts 513 and 515 are provided on a top surface and a bottom surface of the cavity 510. Further, a convection chamber 517 that is communicated with the cooking chamber 511 is provided in a rear surface of the cavity 510.

Meanwhile, a plurality of heating sources that supply energy for cooking food inside the cooking chamber 511 are provided. In the present embodiment, the heating sources include an upper heater, a lower heater, and a convection heater.

More specifically, the upper heater and the lower heater are installed on an upper portion and a lower portion of the cavity corresponding to an upper portion and a lower portion of the opening parts 513 and 515, respectively. The upper heater and the lower heater supply energy to the inside of the cooking chamber 511, respectively, through the opening part 513 formed on the top surface or the bottom surface of the cavity 510.

In addition, the convection heater is installed inside the convection chamber 517. The convection heater supplies energy to air that circulates the insides of the cooking chamber 511 and the convection chamber 517. To this end, a convection fan 551 is installed inside the convection chamber 517.

In the embodiment, the upper heater, the lower heater, and the convection heater are used as carbon heaters 520, 530, and 530, respectively. Hereinafter, for convenience of explanation, the upper heater will be referred to as the first carbon heater 520, the lower heater will be referred to as the second carbon heater 530, and the convection heater will be referred to as the third carbon heater 530. The constitutions of the first to third carbon heaters 520, 530 and 550 are the same as the carbon heater 220 in the first embodiment so that the detailed description thereof will be omitted. However, the first and second carbon heaters 520 and 530 that are used as the upper heater and the lower heater are formed in a rectangular shape, differently from the carbon heater 220 in the first embodiment.

Ceramic glasses 514 and 516 are installed in the opening parts 513 and 515 corresponding to between the first carbon heater 520 and the cooking chamber, and between the second carbon heater 530 and the cooking chamber, respectively. The ceramic glasses 514 and 516 prevent the first carbon heater 520 and the second carbon heater 530 from being polluted due to the pollutant generated during the cooking process of foods inside the cooking chamber 511 as the energy of the first carbon heater 520 and the second heater 530 is transferred to the inside of the cooking chamber 511.

In addition, reflectors 521 and 531 that reflect the energy of the first carbon heater 520 and/or the second carbon heater 530 to the inside of the cooking chamber 511, and heater covers 523 and 533 that shield the first carbon heater 520 and the reflector 521, and the second carbon heater 530 and the reflector 531, respectively, may be provided on the upper portion or the lower portion of the cavity 510.

Although the preferred embodiment is described, it will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

In the fourth embodiment as described above, although all of the upper heater, the lower heater, and the convection heater are described to be used as the carbon heaters, but only any one of the lower heater and the lower heater and the convection heater may be used as the carbon heaters. Also, the upper heater and the lower heater may be formed in a U letter type rather than in a straight line type.

First, in the embodiments, the carbon heater with high output is used as the convection heater for heating food inside the cooking chamber. Therefore, more efficient and rapid cooking of food by the cooker can be made.

In addition, in the embodiments, the convection heater is fixed to the inside of the convection chamber by the heater bracket and heater holder. Therefore, the damage of the convection heater is minimized, making it possible to more safely use the cooker.

Furthermore, in the embodiments, the convection heater, being fixed to the inside of the convection chamber, is connected to the power unit by the power connecting part. Therefore, while connecting the convection heater to the power unit, a phenomenon that the convection heater is damaged can be prevented.

What is claimed is:

1. A cooker, comprising:

a cavity that is provided with a cooking chamber;

a convection chamber in communication with the cooking chamber;

a plate that partitions the cooking chamber and the convection chamber;

a carbon heater that is installed inside the convection chamber and includes a quartz tube and a carbon filament provided inside the quartz tube;

a fastener to fix the carbon heater to an interior of the convection chamber, wherein the fastener includes a bracket coupled to ends of the carbon heater; and a convection fan that is installed inside the convection chamber and forms a flow of air that transfers heat from the carbon heater to an interior of the cooking chamber, wherein the bracket includes:

a first supporter disposed at upper sides of the ends of the carbon heater and provided with a first fixing part; and a second supporter disposed at lower sides of the ends of the carbon heater and provided with a second fixing part, wherein the second fixing part is coupled to the first fixing part so that the first and second supporters surround the ends of the carbon heater.

2. The cooker according to claim 1, wherein the bracket penetrates through a rear surface of the convection chamber and extends outside of the convection chamber to allow the ends of the carbon heater to be fixed by the first and second supporters.

3. The cooker according to claim 2, wherein an end of the carbon heater penetrates through a heater penetrating hole formed on the rear surface of the convection chamber and a portion of the heater bracket penetrates through a bracket penetrating slot formed on the rear surface of the convection chamber.

4. The cooker according to claim 2, wherein at least one of the first supporter or the second supporter includes:

a heater seating part on which the carbon heater is seated;

a fixing part that is fixed to the convection chamber; and a heater fixing part that fixes the carbon heater seated on the heater seating parts.

5. The cooker according to claim 1, wherein one of the first fixing part or the second fixing part includes a fixing rib and the other of the first fixing part or the second fixing part includes a fixing slot to receive the fixing rib.

6. The cooker according to claim 5, further comprising a hooking rib elastically coupled adjacent to the fixing rib.

7. The cooker according to claim 1, wherein a portion of heat from the carbon heater is transferred to the interior of the cooking chamber by the plate.

8. The cooker according to claim 1, wherein the plate is convection cover that is spaced from a back plate that forms a rear surface of the cooking chamber at a predetermined interval.

9. The cooker according to claim 1, wherein an outlet that discharges air heated by the carbon heater to the interior of the cooking chamber from the inside of the convection chamber is formed between the back plate corresponding to ends, or upper and lower ends, of the convection chamber and the convection cover, and wherein an inlet that inhales air inside the cooking chamber into the inside of the convection chamber is formed in the convection cover.

10. The cooker according to claim 1, wherein the plate is provided with one or more openings that transfer light and heat generated from the carbon heater to the interior of the cooking chamber.

11. The cooker according to claim 1, further comprising:

an air guiding part that guides air inhaled to the interior of the convection chamber by the convection fan to contact the carbon heater.

12. The cooker according to claim 11, wherein the air guiding part is formed at a portion of the convection chamber for interfering a flow of air flowed by the convection fan.

13. The cooker according to claim 11, wherein the air guiding part is at least partially located in a recess in at least one of a front surface or a rear surface of the convection chamber.

14. The cooker according to claim 1, wherein a wavelength band where a radiant energy is maximum, of the carbon heater is 1.5 to 2.5 um.

15. The cooker according to claim 1, wherein a maximum effective temperature of the carbon heater is 1500° C. or less.

16. The cooker according to claim 1, wherein an effective temperature band of the carbon heater lies substantially in a range of between 1000 ° C. to 1400 ° C.

17. The cooker according to claim 1, further comprising:

another carbon heater that provides heat radiated to the inside of the cooking chamber in order to cook the food.

18. A cooker, comprising:

a cavity that is provided with a cooking chamber;

a convection chamber that is in communication with the cooking chamber;

a plate that partitions the cooking chamber and the convection chamber;

a back plate forming a rear surface of the convention chamber;

a carbon heater that is installed inside the convection chamber and includes a quartz tube and a carbon filament provided inside the quartz tube;

a fastener that elastically fastens the carbon heater to the inside of the convection chamber, the fastener including a bracket coupled to ends of the carbon heater; and a convection fan that is installed inside the convection chamber and forms a flow of air that transfer heat from the carbon heater to an interior of the cooking chamber, wherein:

the back plate includes a first hole and a second hole, and the ends of the carbon heater and a portion of the bracket pass through respective ones of the first and second holes to extend outside the convection chamber.

19. The cooker according to claim 18, wherein;

the fastener includes a supporter that supports a portion of the carbon heater, and the supporter is spaced from at least one of the ends of the carbon heater.

* * * * *